US005375351A

United States Patent [19]

King et al.

[11] Patent Number: 5,375,351

[45] Date of Patent: Dec. 27, 1994

[54] GREETING CARD WITH MAGNETIC PICTURE FRAME

[76] Inventors: John R. King; Feather W. King, both of 165 Reiten Dr., Ashland, Oreg. 97520

[21] Appl. No.: 206,216

[22] Filed: Mar. 7, 1994

Related U.S. Application Data

[63] Continuation of Ser. No. 309,179, Feb. 13, 1989, abandoned, which is a continuation-in-part of Ser. No. 233,568, Aug. 18, 1988, abandoned.

[51] Int. Cl.[5] ..... G09F 1/00

[52] U.S. Cl. ..... 40/124.1; 40/152; 40/159

[58] Field of Search ..... 40/124.1, 152, 156, 40/158.1, 159, 600, 621; 428/900

[56] References Cited

U.S. PATENT DOCUMENTS

| | | | |
|---|---|---|---|
| 2,176,535 | 10/1939 | Markoff | 40/159 |
| 2,256,399 | 9/1941 | MacHarg | 40/158.1 |
| 2,785,490 | 3/1957 | Fabry | 40/621 |
| 2,844,901 | 7/1958 | Eisen | 40/158.1 |
| 2,984,922 | 5/1961 | Ladenburger et al. | 40/159 |
| 3,124,501 | 3/1964 | Wise | 428/900 |
| 3,444,638 | 5/1969 | Jahn | 40/158 |
| 3,716,935 | 2/1973 | Friederichs | 40/621 |
| 3,826,026 | 7/1974 | Bevan | 40/600 |
| 4,079,881 | 3/1978 | Sabb | 40/158.1 |
| 4,200,222 | 4/1980 | Feuer | 40/124.1 |
| 4,310,978 | 10/1982 | Stern | 40/600 |
| 4,439,941 | 4/1984 | Halperin | 40/158.1 |
| 4,605,292 | 8/1986 | McIntosh | 248/206.5 |
| 4,662,093 | 5/1982 | Suttles | 40/159 |
| 4,785,562 | 11/1988 | Good | 40/159.1 |
| 4,794,716 | 1/1989 | George et al. | 40/158.1 |
| 4,852,282 | 8/1989 | Selman | 40/600 |

FOREIGN PATENT DOCUMENTS

| | | | |
|---|---|---|---|
| 860290 | 12/1952 | Germany | 40/110 |

*Primary Examiner*—Brian K. Green
*Attorney, Agent, or Firm*—Thomas M. Freiburger

[57] ABSTRACT

A greeting card has on its front surface a picture frame formed of a single, integral piece of magnetic sheeting. The magnetic sheeting picture frame is held to the front of the card by adhesive which will release the frame when the frame is pulled away with a small amount of force. The one-piece integral frame has a central opening for cropping and displaying a photograph or other picture on the front of the greeting card, inserted between the front of the greeting card and the back of the magnetic frame. The releasable adhesive can be in contact with the back surface of the frame along three legs but not along the fourth, so that a purchaser of the greeting card can slide a picture down between the card and the frame. Alternatively, the adhesive can contact all four legs of the back surface of the frame, with the frame to be pulled off and replaced by the purchaser to retain a picture behind the frame. The magnetic picture frame when removed can be used by the recipient of the card to hold the picture (or any other display article) against a metal surface such as a refrigerator door or a desk top flat ferrous metal stand, to display the picture.

5 Claims, 3 Drawing Sheets

GREETING CARD WITH MAGNETIC PICTURE FRAME

REFERENCE TO RELATED APPLICATION

This is a continuation of co-pending application Ser. No. 07/309,179 filed on Feb. 13, 1989 now abandoned, which was a continuation-in-part of application Ser. No. 233,568, filed Aug. 18, 1988, now abandoned.

BACKGROUND OF THE INVENTION

The invention is concerned with greeting cards, and in particular relates to a greeting card having a cover surface which will receive a picture inserted by the purchaser and which has a removable frame usable by the recipient separately from this greeting card.

Greeting cards containing or displaying pictures have been disclosed in a number of different forms. Further, magnetic picture frames for holding pictures and other flat objects for display against ferrous metal surfaces have been disclosed previously. See, for example, U.S. Pat. Nos. 3,124,501, 3,187,449, 3,456,374, 3,698,111, 3,965,599 and 4,310,978. The cited patents show frames having individual metal magnets secured to multiple-component frame structures or magnetic sheeting used as one of several layers of the frame apparatus. All of the patents disclosed frame structures formed of a plurality of assembled components as part of the framing apparatus.

Another known magnetic picture frame construction involved a back sheet of magnetic sheeting, connected by an edge hinge to a nonmagnetic cover layer. A picture or other display article was inserted between the two layers, then the layers were snapped together in closed position.

Other prior patents of interest, showing use of magnets or magnetic sheeting, include the following: U.S. Pat. Nos. 2,957,261, 3,289,338, 3,372,503, 3,508,356, 3,987,567 and 4,236,331.

None of the previous magnetic frame constructions had the structure and advantages of the magnetic frame included in the present invention. Further, no previous greeting card construction combined such a frame in a manner as described below, so that the greeting card in effect serves more than one purpose.

SUMMARY OF THE INVENTION

In accordance with the present invention, a greeting card with a magnetic picture frame comprises a preferably folded card insertable into a mailing envelope for containing the card. On the front of the card is a magnetic picture frame temporarily adhered to the card's surface with releasable adhesive. The frame can hold a picture on the front of the greeting card, and can later be removed by the recipient of the greeting card, such that the recipient can then use the magnetic frame to display the picture against a ferrous metal surface such as that of a refrigerator.

An important feature of the invention is that the magnetic picture frame comprises an integral piece of magnetic sheeting material with an opening of appropriate size and shape to display an area of interest of a picture or other flat display article. The frame has no backing or any other components other than the backing providing by the card itself, when the frame is in place on the front of the card.

The adhesive for holding the frame temporarily on the card may comprise double sided tape, having one side which becomes permanently adhered to the greeting card and an outer side which is only releasably adhered to the back side of the magnetic frame. The double sided tape or other adhesive can be applied in a U-shape, leaving one end or leg of the frame non-adhered (ordinarily the top end) so that a picture can be slipped behind the frame, between the frame and the card. Alternatively, the magnetic frame can be adhered on all four legs of the frame, with the purchaser instructed to pull the frame off the card, lay the picture in place, then replace the frame on the card. The magnetic picture frame has outer dimensions sufficient to cover the edges of a flat article to be displayed, and preferably the dimensions of the frame exceed those of the flat article sufficiently so that the flat article can be laterally shifted into the desired position to display the area of interest as selected without exposing edges of the article outside the edges of the frame.

On the front of the magnetic sheeting picture frame there may be included decorative embossings, graphic art work, border lines, or various colors, as desired for embellishment of the appearance of the frame and of the displayed picture or other article.

The greeting card of the invention is purchased with the magnetic frame non-permanently secured to the front sheet of the card. The purchaser inserts a picture or other article of his choice behind the frame, so as to personalize the greeting card as desired. The inside surfaces of the card can be used to display a pre-printed message, or any message written by the purchaser.

The card is then inserted into the envelope and sent to a recipient. Preferably, there are included instructions for the recipient to pull the magnetic sheeting picture frame off the front of the card. As noted above, the adhesive will remain on the front of the card, not on the back of the frame. This enables the frame to be used to display the picture (or another flat display article of the recipient's choice) on a refrigerator door, a file cabinet, or other flat ferrous metal surface. The picture frame simply presses and holds the picture magnetically against the flat metal surface.

Accordingly, it is among the objects of the present invention to provide a greeting card which includes a simple magnetic picture frame serving two purposes-to personalize the card enabling a purchaser to place a picture or other flat article of his choice on the front of the card; and to enable the end recipient of the card to peel the magnetic frame off the card and to use it for displaying the picture (or another flat display article) on a surface such as a refrigerator. These and other objects, advantages and features of the invention will be apparent from the following description of a preferred embodiment, considered along with the accompanying drawings.

DESCRIPTION OF PREFERRED EMBODIMENTS

Figure 1:
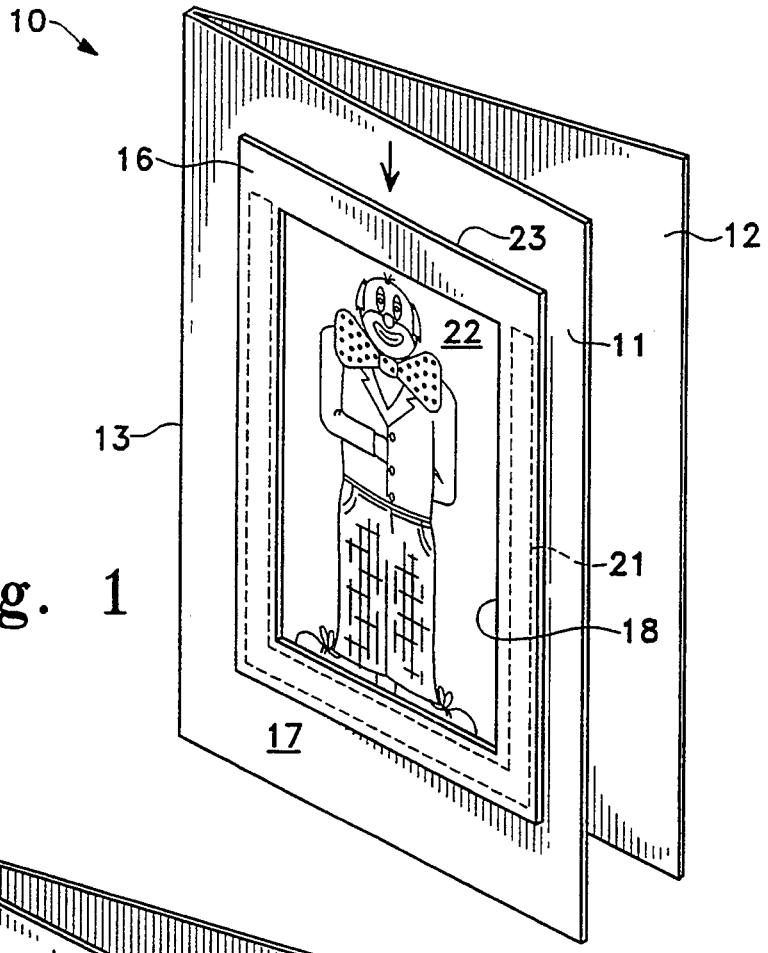
FIG. 1 is a perspective view showing a greeting card in accordance with the invention, having a magnetic picture frame secured to its front cover surface. A picture is shown retained between the frame and the greeting card surface.

In the drawings, FIG. 1 shows a greeting card 10 in accordance with the principles of the invention. The greeting card 10 includes a front leaf 11, preferably integral with a back leaf 12, connected along a fold line 13 in the manner typical of greeting cards. However, the greeting card can comprise a single front leaf 11, if desired, with a message to the recipient to be positioned on the back of the front leaf or in the margins of the front surface.

The greeting card of the invention includes a picture frame 16 secured non-permanently to the front surface 17 of the front leaf 11. In accordance with the invention, the picture frame 16 comprises a magnetic picture frame, formed integrally of a single piece of magnetic sheeting material, with a central opening or window 18. The magnetic sheeting picture frame is thin and of low profile, as in typical magnetic sheeting material, and as shown in the drawing, is generally on the same order of thickness as the greeting card itself. The picture frame 16 is attached to the front surface of the greeting card by an appropriate form of adhesive which will allow the ultimate recipient of the greeting card to remove the picture frame. This may be by double-sided tape or adhesive 21, which may be applied in a U-shaped pattern as shown in dashed lines in FIG. 1 and also in FIG. 2 (with the frame removed). The U-shaped pattern of adhesive allows a picture 22 to be slipped behind the picture frame, between the frame and the front surface of the card, since there is one non-adhered leg 23 of the frame, preferably located at the top.

Figure 2:
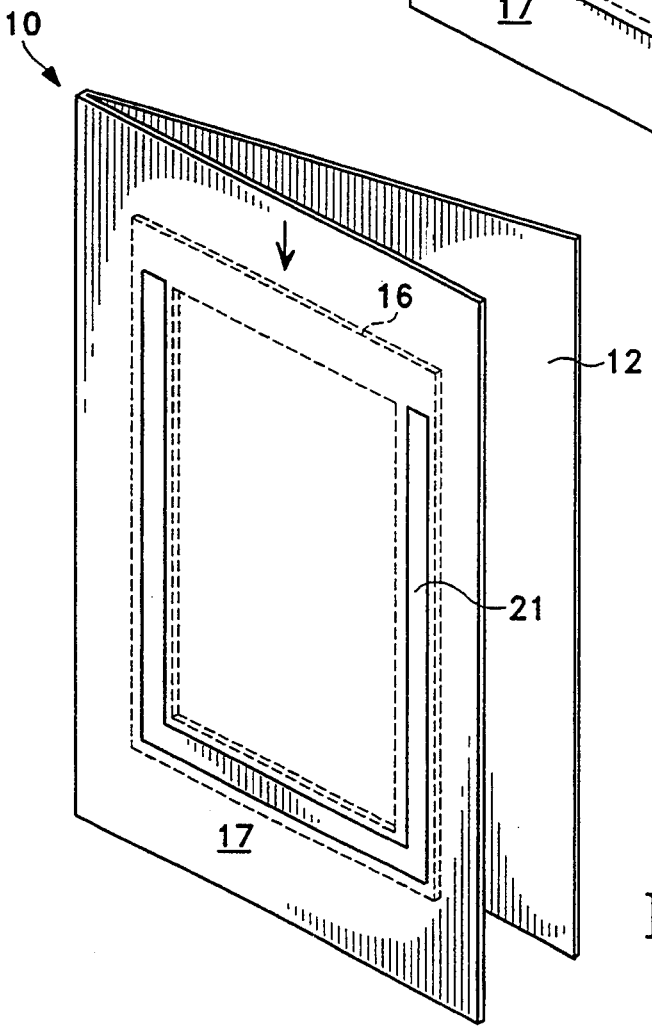
FIG. 2 is a similar perspective view, showing the greeting card without the magnetic picture frame.
Figure 3:
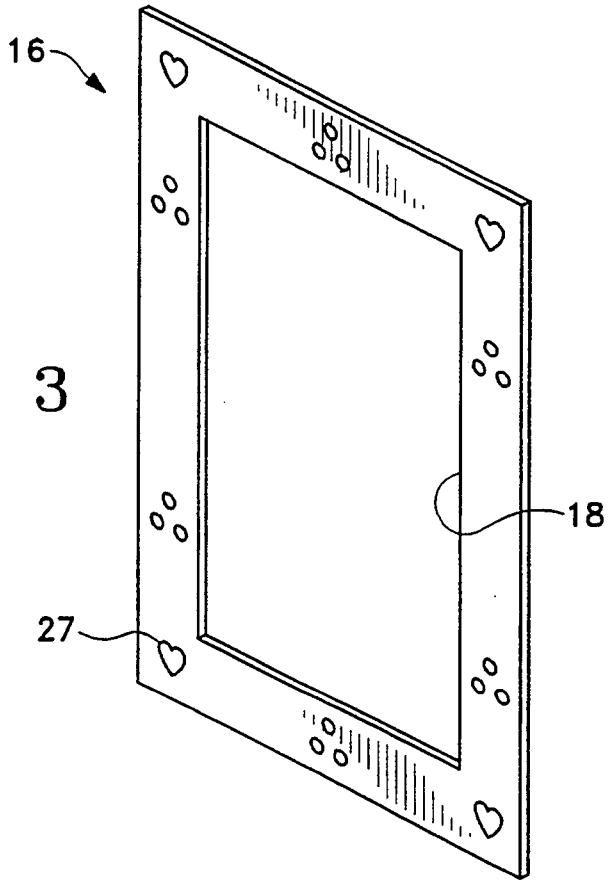
FIG. 3 is a perspective view showing the magnetic picture frame removed from the greeting card.
Figure 4:
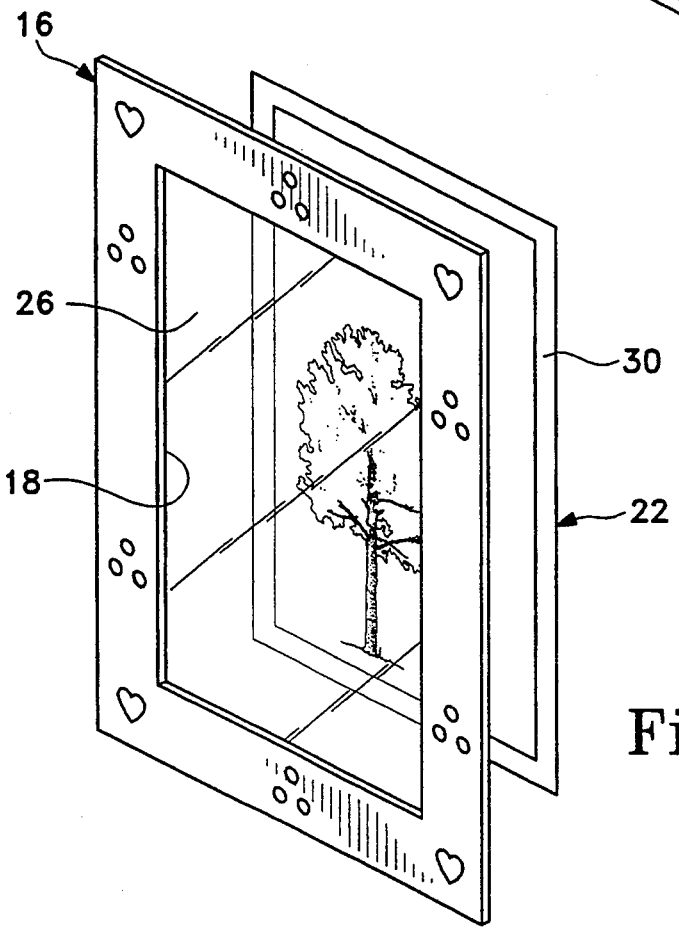
FIG. 4 is a similar perspective view showing a picture positioner behind the magnetic picture frame, in a position to be framed.
Figure 5:
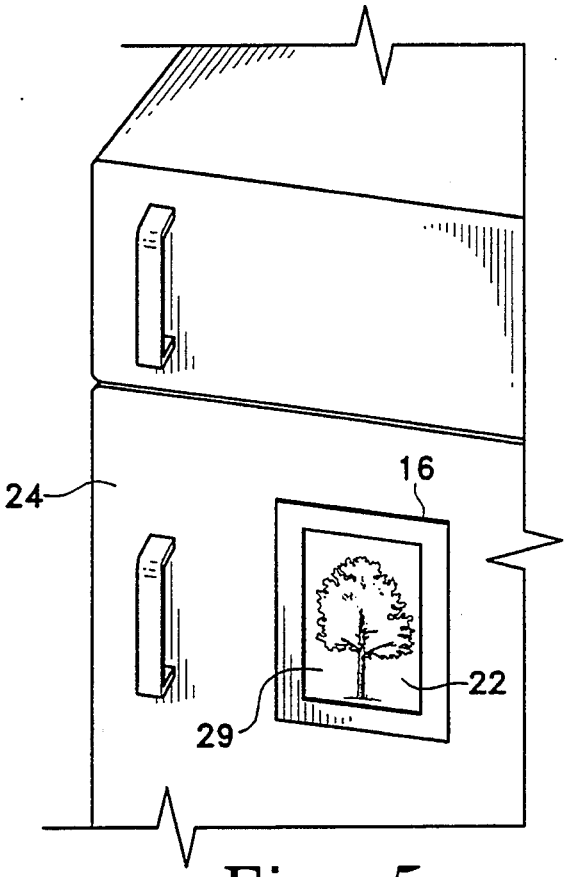
FIG. 5 is a perspective view showing the magnetic picture frame retaining a picture or other display article on the front of a refrigerator (or other metal surface) with the area of interest of the picture displayed.

Alternatively, the adhesive used, in combination with the surfaces of the back of the magnetic sheeting and the front of the greeting card, is such that the frame may be somewhat easily removed from the adhesive, with the adhesive remaining on the card surface and not adhering to the frame upon removal. This enables the frame to be removed by the recipient of the card, as indicated in FIGS. 2 and 3, then placed against the picture 22 or other display article and used to hold the picture against a ferrous metal surface. This can be the door or side panel of a refrigerator 24, as illustrated in FIGS. 4 and 5. The picture frame thus not only holds the picture up on the refrigerator or other surface but also frames the picture in a decorative way.

In this way, the greeting card 10 of the invention serves several purposes—it enables a purchaser to "personalize" the greeting card, placing a picture of his or her choice in the card; it serves also as a conventional greeting card, enabling the purchaser to include an appropriate message inside the card or underneath the picture on the front surface (either pre-printed or written by the purchaser); and it provides an end product which can be used by the recipient of the card, for retaining the mailed picture and displaying it permanently and decoratively, without the card.

Figure 6:
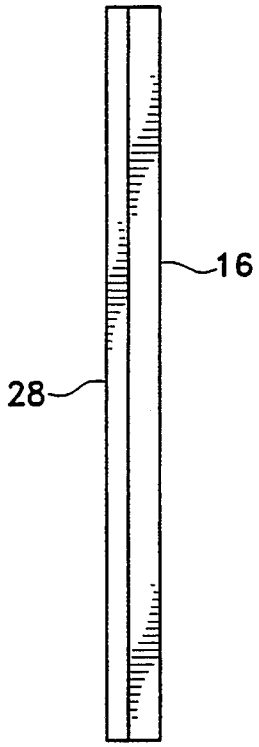
FIG. 6 is an elevation view showing the edge of a modified form of magnetic picture frame which may be used with the greeting card of the invention.

The magnetic sheeting picture frame 16 is formed integrally, in one piece, from the well-known flexible magnetizable plastic composite material which is known as magnetic sheeting. In its holding and framing functions, it is formed of a single piece, without any additional elements. However, as indicated in FIG. 4, the magnetic picture frame may optionally have attached a transparent plastic window or cover sheet 26, preferably adhered to the back side of the picture frame along a sufficient margin to retain it The magnetic picture frame 16 may include decorative painting or embossing 27, as illustrated in the drawings. Optionally, these decorations 27 may be included on a stick-on paper or plastic sheet 28, as indicated in the side elevation view of FIG. 6. This affords more versatility in the nature and variety of decorative embellishments used on the magnetic picture frame. The end user or recipient may have available a number of different stick-on decorative covers for addition to the magnetic frame, or the initial purchaser may have such options available.

The dimensions of the magnetic picture frame 16 preferably are such as to crop and appropriately frame a standard size photograph. Thus, the frame preferably has outer dimensions at least as large as those of a picture (or other display item) to be framed, with the outer dimensions preferably larger than the picture from edge to edge, so that the picture can be manipulated into a desired position to crop as desired by the end user and to expose for display only an area of interest 29 selected by the end user. The larger size of the frame enables this to be done without exposing edges of the picture outside the area covered by the frame.

The picture 22 may have borders 30 which are to be cropped and covered, and additional area of the picture may be covered, depending on the opening size 18 in the particular frame on the card selected by the purchaser.

When the end user/recipient removes the picture frame 10 for use in displaying a picture, he simply places the magnetic frame against a ferrous metal surface 24, with the picture or display item engaged between the magnetic frame and the metal surface. The frame 16 is laterally shifted with respect to the framed picture 22 (or the picture is shifted) until the picture is cropped and framed as desired, exposing and displaying only the selected area of interest. The magnetic sheeting has ample strength to hold the displayed item in place, even if the sheeting makes no direct contact with the metal surface (which it normally will).

Even with a stick-on decorative layer 28, or with a transparent window 26 described above, the frame 10 is still considered to be integral and contiguous and without any additional attached component relating to the framing or holding function of the magnetic frame 16. The basic frame 16 frames the picture; the front layer 28 merely provides decoration on the frame, and the window serves the function of keeping the picture clean.

Figure 7:
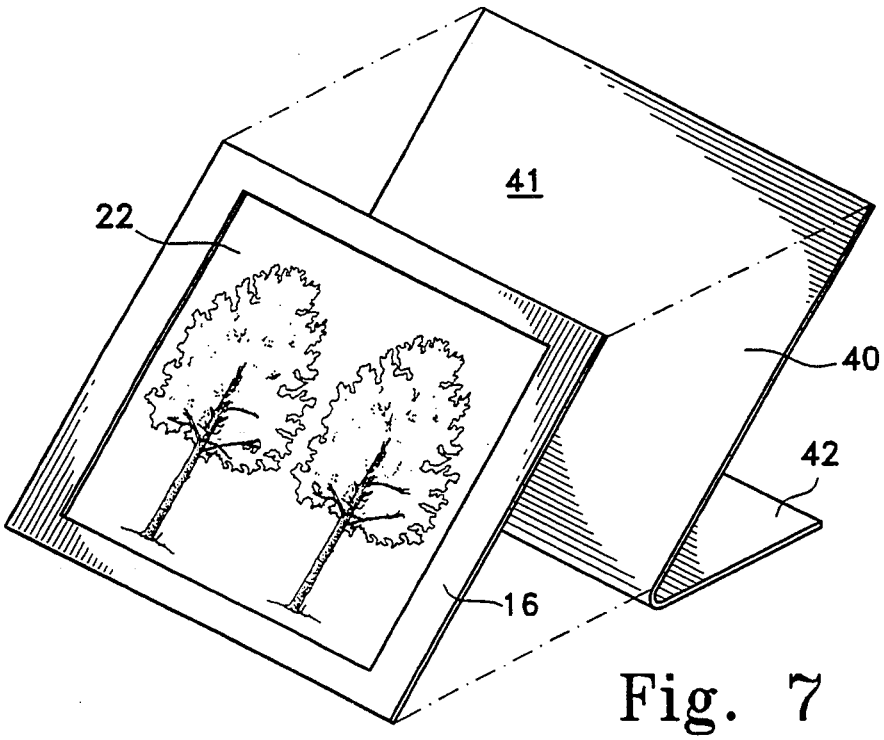
FIG. 7 is a perspective exploded view illustrating a particular use of the magnetic picture frame, wherein it is attached to a metal frame stand for use as a desk top frame.

FIG. 7 illustrates another, specialized use of the magnetic picture frame 16, with a desk top picture frame stand 40. In this embodiment of the invention, the magnetic picture frame 16 is placed against a similarly-sized angled flat portion 41 of the desk top stand 40, with a photograph or other picture or display article 22 engaged between the magnetic frame and the stand portion 41. A base portion 42 of the stand, which extends from the angled portion 41 at an acute angle as illustrated, provides a base for resting the stand on a desk or other horizontal surface. At least the upwardly extending flat portion 41 is of ferrous metal. In the preferred embodiment the stand 40 is integrally formed.

The magnetic picture frame 16 may be attached to the frame stand 40 by a recipient of the greeting card/-frame combination 10 described above, or the magnetic frame 16 and the metal stand 40 can comprise a picture frame assembly in themselves. In any event, the metal stand 40 and the magnetic frame 16 in combination comprise another embodiment of the present invention.

The magnetic frame 16 therefore has a number of uses. It can bear very attractive artwork, with each border leg of the frame being of significant width for displaying the artwork. It can be used with the greeting card as described above, with a releasable adhesive attaching the frame thereto for holding a picture on the front of a greeting card. Once received by a recipient, the magnetic picture frame can be removed from the front of the greeting card and used to display a picture or other flat article on a ferrous metal surface such as a refrigerator. Alternatively, the frame can be used in combination with the metal desk top stand 40 shown in FIG. 7, as a separate and free-standing picture frame assembly unit.

The above described preferred embodiments are intended to illustrate the principles of the invention, but not to limit its scope. Other embodiments and variations to these preferred embodiments will be apparent to those skilled in the art and may be made without departing from the scope of the invention as defined in the following claims.

We claim:

1. A picture frame greeting card for sending a greeting to a recipient and also for the recipient's receipt of a picture or display article selected by the purchaser and for providing the recipient with a frame usable both on the card and separately from the card, comprising, a greeting card having a least a front leaf with a front surface and a back surface, and having a location for inclusion of a message intended for a recipient of the card, a magnetic picture frame of flat, low profile with a central opening for display of a picture or other display article having edges, with the magnetic picture frame being of appropriate size and shape for framing a picture, displaying an area of interest of the picture through the central opening and covering the edges of the picture, the magnetic picture frame comprising a single, integral, thin piece of magnetic sheeting material, and non-permanent adhesive means on the front surface of the greeting card, engaged with the back surface of the magnetic picture frame and securing the picture frame onto the front surface of the greeting card in a manner permitting removal of the magnetic picture frame while leaving the adhesive means on the greeting card, whereby a purchaser of the greeting card may place a picture or other display article of his choice between the magnetic picture frame and the front surface of the greeting card, so as to display the desired picture or article on the front of the greeting card; the greeting card with the picture may be sent to a recipient; and the recipient may remove the magnetic picture frame and picture from the card, and use the picture frame to hold and display the picture or another article on a ferrous metal surface.

2. A picture frame greeting card according to claim 1, wherein the adhesive means is applied to the front surface of the greeting card in a U-shaped pattern, so that one leg of the picture frame is not adhered to the card, enabling the picture to be slipped under and behind that leg of the frame to position it on the card.

3. A picture frame greeting card according to claim 1, further including a transparent window sheet across and adhered to the magnetic sheeting picture frame.

4. A picture frame greeting card according to claim 1, further including a decorative front layer on the magnetic sheeting picture frame, generally conforming to the size and shape of the magnetic sheeting, secured to the front of the magnetic sheeting to add a decorative appearance to the frame and the framed article.

5. A picture frame greeting card according to claim 1, wherein the dimensions of the piece of magnetic sheeting material are larger than those of the picture or other display article to be framed, with said central opening smaller than the dimensions of the picture or other article.

* * * * *